United States Patent [19]

Morreall et al.

[11] 4,189,998

[45] Feb. 26, 1980

[54] PRINT HAMMER AND INTERPOSER CAPTIVATING LINKAGE

[75] Inventors: Donald R. Morreall, New Hartford, N.Y.; Ronald F. Deuel, Shrewsbury, Pa.

[73] Assignee: Mohawk Data Sciences Corp., Parsippany, N.J.

[21] Appl. No.: 884,865

[22] Filed: Mar. 9, 1978

Related U.S. Application Data

[62] Division of Ser. No. 724,427, Sep. 17, 1976, Pat. No. 4,106,406.

[51] Int. Cl.[2] ..... B41J 9/36

[52] U.S. Cl. ..... 101/93.31; 101/93.02; 101/93.48

[58] Field of Search ..... 101/93.02, 93.29, 93.30, 101/93.31, 93.32, 93.33, 93.34, 93.48, 93.14

[56] References Cited

U.S. PATENT DOCUMENTS

| | | | |
|---|---|---|---|
| 2,766,686 | 10/1956 | Famenko et al. | 101/93.31 |
| 3,255,693 | 6/1966 | Eissfeldt et al. | 101/93.31 |
| 3,517,611 | 6/1970 | Fink | 101/93.31 |
| 3,587,456 | 6/1971 | Jaensch | 101/93.31 |
| 3,643,595 | 2/1972 | Helms et al. | 101/93.34 |
| 3,673,956 | 7/1972 | Huber et al. | 101/93.31 |
| 3,780,648 | 12/1973 | Curtiss et al. | 101/93.02 |
| 3,960,075 | 6/1976 | Babler | 101/93.48 |
| 3,964,384 | 6/1976 | Johnston | 101/93.29 X |
| 3,983,806 | 10/1976 | Ishi | 101/93.34 X |
| 3,998,154 | 12/1976 | Real et al. | 101/93.48 |

*Primary Examiner*—Edward M. Coven
*Attorney, Agent, or Firm*—Robert R. Hubbard

[57] ABSTRACT

A print hammer mechanism with a flexible interposer selectively moveable from a normal position into the path of a rotating impeller tooth which engages the interposer driving it and the associated hammer toward a print line to impact a print medium with a type die on a moving carrier. The interposer is flexible in the plane of motion of the hammer and the impeller tooth which allows slower and more controlled acceleration of the hammer and enhances the wear of the materials used to fabricate the hammer, interposer and impeller tooth. Uncontrolled oscillation of the flexible interposer and, hence, multiple strikes and multiple rebounds from the print hammer back stop are prevented by means of a mechanical linkage which captivates the interposer to the hammer for travel with the hammer but also allows the interposer to move from its normal position into the path of the impeller tooth and to return to its normal position.

4 Claims, 17 Drawing Figures

PRINT HAMMER AND INTERPOSER CAPTIVATING LINKAGE

This a division of application Ser. No. 724,427 filed Sept. 17, 1976, now U.S. Pat. No. 4,106,406.

BACKGROUND OF INVENTION

A. Field of Invention

This invention relates to impact printing machines and in particular to a novel and improved impact printing apparatus of the class employing a continuously rotating impeller to impart accelerating forces to one or more print hammers via one or more selectively actuable interposers.

In impact printers a plurality of type die are mounted upon a moving type carrier (such as a drum or an endless belt) which periodically presents the type die to an imaginary print line adjacent a printing medium including a document. A plurality of print hammer mechanisms are aligned with the print line and are responsive to electrical signals to selectively impact the document with selected ones of the moving type die to effect printing of characters representing the selected type die on the document.

B. Prior Art

Prior art printing mechanisms have used a source of mechanical energy such as a continuously rotating impeller with one or more impeller teeth which are aligned with corresponding print hammers. Associated with each impeller tooth and a corresponding print hammer is an interposer element which is selectively moveable from a normal position into the path of motion of the impeller tooth such that the impeller tooth engages the interposer driving it and the corresponding print hammer toward the print line to impact the printing medium with a selective type die. Heretofore such printing mechanisms have been characterized by rather complex interposer and print hammer linkages having a rather large number of parts which are difficult to assemble and/or maintain, and therefore, rather costly. In addition, such prior art printing mechanisms have used interposers which are rigid and nonflexible in the plane of motion of the impeller tooth and print hammer. The rotating impeller tooth engages such a rigid interposer rather abrubtly and imparts rapid and uncontrolled acceleration forces thereto. This results in abnormal wear or rapid deterioration of the material forming the interposer, print hammer and impeller. Because of this, expensive materials have had to be employed for such parts.

BRIEF SUMMARY OF THE INVENTION

Briefly, print impacting apparatus embodying the present invention is contemplated for use in an impact printer which has a printer frame to which is mounted a continuously moving carrier for periodically presenting a plurality of type die to a print line adjacent a document on which a printing operation is to be performed. A print impacting mechanism includes at least one print hammer, an impeller and an interposer. The print hammer is arranged to impact the document with selected ones of the type die at the print line. The impeller has at least one impeller tooth rotating in synchronism with the periodic presentation of the type die by the carrier. The interposer has a mass smaller than that of the hammer and is arranged for selective movement by a control element from a normal position into the path of motion of the impeller tooth such that the impeller tooth engages the interposer driving it and the associated print hammer toward the print line to impact the document with the selected type die. A print impacting mechanism embodying this invention is characterized by the interposer being mechanically coupled to the print hammer in a linkage which allows motion of the interposer into and out of the path of the impeller tooth and captivates the interposer to travel with the hammer after engagement of the interposer by the impeller tooth and also characterized by the interposer being flexible in the plane of motion of the hammer and impeller tooth.

The flexibility of the interposer results in slower and more controlled acceleration of the hammer and enhances the longevity of the materials used for the hammer interposer and impeller. The captivation of the flexible interposer to the hammer prevents the interposer from rebounding from the hammer and being re-engaged by the impeller in a multiple strike situation.

In one preferred embodiment the print hammer is elongated with a print hammer head formed at one of its ends and the other of its ends being secured to the impact printer frame so as to allow pivotal motion of the print hammer. Preferably, this is achieved by means of a flat flexure spring which is adapted to flex in the plane of motion of the print hammer to thereby provide the pivotal motion. The use of a flat flexure spring leads to still another important feature of the invention. That is, by proper choice of the spring rates of the flexure spring and the flexible interposer, the rebound motion of the print hammer can be damped so as to prevent uncontrolled multiple rebounds of the hammer from a backstop as well as limit the time required for the hammer to return to its rest condition. In this preferred embodiment an important feature of the invention is that the mechanical linkage is characterized by means which captivates the interposer to the hammer at a first point in proximity to the hammer head and at a second point in proximity to the other end of the hammer. This controls flexing and oscillation of the interposer between these two points.

In some preferred embodiments the flexible interposer takes the form of an elongated flat spring having a length L and a generally rectangular cross-section of dimensions x and y where $x>y$. In one such embodiment using a flat interposer, the print hammer body is characterized by a pair of spaced apart and generally parallel surfaces defined by a base end and a hammer head end by a front and a back edge. The hammer head end has a hammer face toward the front edge and an interposer striking face toward the back edge. First and second spaced apart portions project from the back edge near the hammer head and base ends. The aforementioned captivating linkage is characterized by an aperture through the second portion in a direction generally parallel to the hammer body surfaces and large enough to allow insertion of the interposer with its x dimension parallel to such surfaces and to also allow rotation thereof until its y dimension is parallel to such surfaces. The linkage is further characterized by a T-shaped opening through the first portion in a direction generally parallel to such surfaces with both legs of the T having a width slightly larger than the dimension y. The crossing of the T has a length slightly larger than x so that the interposer may be inserted through both the aperture and the opening with its x dimension parallel to said surfaces and then rotates until it fits entirely within the cross leg of the T-shaped opening with its y dimension parallel to the hammer body surfaces.

A significant aspect of this embodiment is its adaptation to use of thermoplastic material and, hence, injection molding processes for manufacture of the hammer body and elements which mount or secure the hammer to the impact printer frame. In accordance with this aspect the print hammer is characterized by a metallic and a thermoplastic portion with the hammer face and interposer striking face being formed from the metallic portion. The flat flexure spring can then be imbedded in the thermoplastic portion of the print hammer body and in a thermoplastic mounting block which is secured to the impact printer frame. Accordingly, one or more print hammer bodies, one or more associated flexure springs and a single plastic mounting block can be formed as a one piece or a unitary structure by means of conventional injection molding processes.

Another important feature of the invention is that a hammer module assembly for attachment to the printer frame can be constructed from only three pieces in addition to fastener elements. This, of course, contributes to ease of manufacture as well as ease of repair and maintenance. The first piece comprises the hammer flexure spring and hammer mounting block. The second piece comprises of the printed circuit board upon which the electromagnet is mounted with its armature directly coupled to the interposer. The third piece comprises of the frame mounting block generally shaped for attachment to the frame and having an upper portion shaped to mate with the hammer mounting block and a lower portion shaped to mate with the printed circuit board. The fastener elements are then used to secure the hammer mounting block and printed circuit board to the frame mounting block.

In another preferred embodiment of the invention the hammer is characterized by a pair of spaced apart and generally parallel surfaces defined by a base edge, a top edge, a hammer base edge and an interposer striking base edge. The linkage is characterized by a snap-dip element which is arranged to captivate the interposer to the interposer striking face edge of the hammer in a snap-on fashion. The print hammer is secured to the impact printer frame by at least two flat flexure springs which are adapted to flex in the plane of motion of the print hammer to thereby provide motion of the hammer from a rest position toward the print line.

BRIEF DESCRIPTION OF THE DRAWINGS

In the accompanying drawings, like reference characters denote like elements of structure.

DESCRIPTION OF PREFERRED EMBODIMENT

It is contemplated that the print hammer mechanism of the present invention may be used in any impact printer regardless of whether the carrier is moving or stationary at the time of impact. However, the hammer is particularly suited for use in high speed impact printers which employ a moving type die carrier (sometimes called on-the-fly printers) as it can be designed for the high velocity and short impact dwell time requirement of such impact printers. It is further contemplated that the print hammer mechanism of the present invention may be employed in either a drum printer in which the carrier takes the form of a continuously rotating drum or in a chain or train printer in which the type die carrier takes the form of a continuously moving, endless belt. However, by way of example on completeness of description, the print hammer mechanism embodied in the present invention is illustrated herein as an impact printer which employs a continuously rotating drum as the type carrier.

Figure 1:
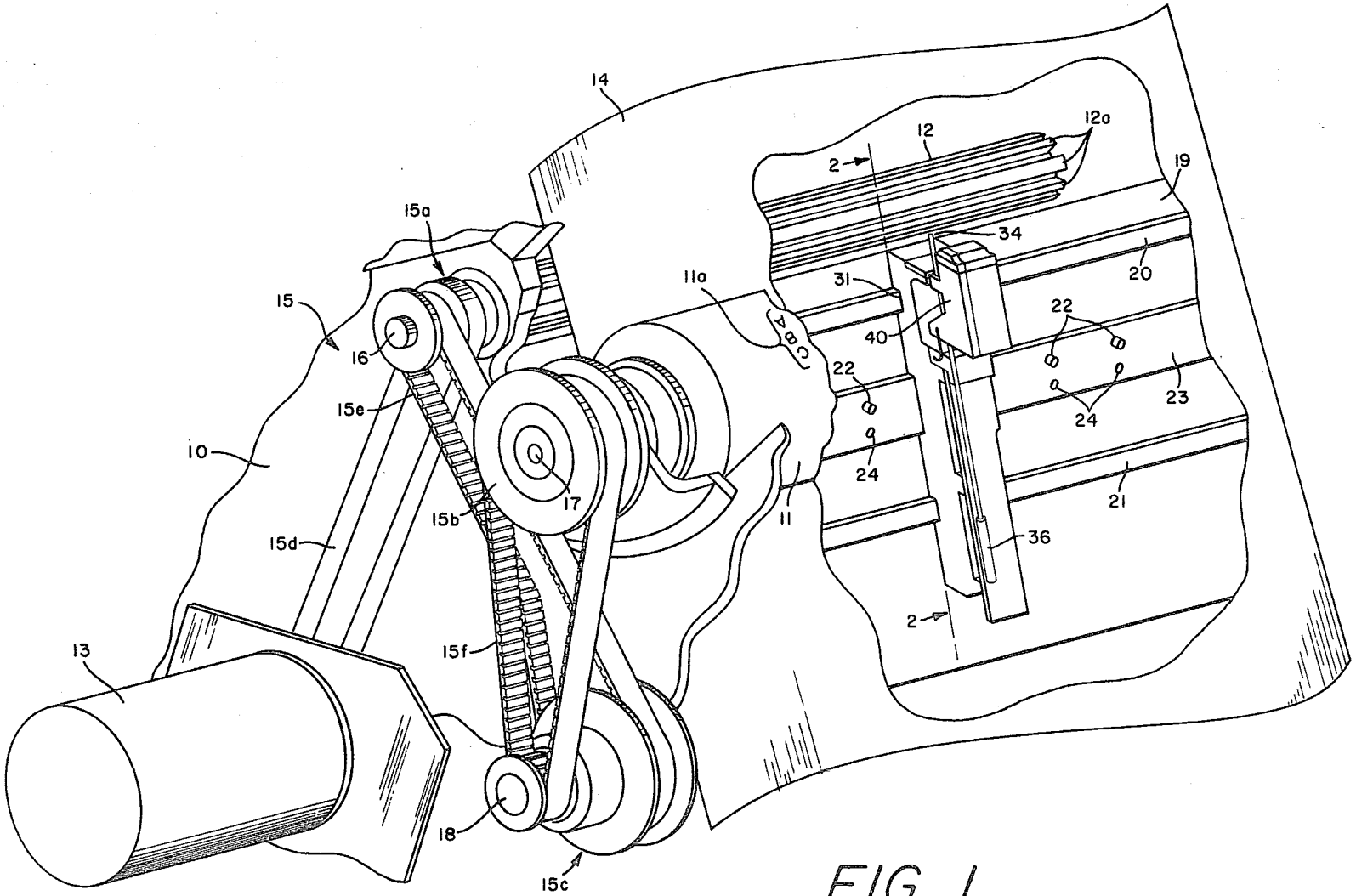
FIG. 1 is a perspective view of a portion of an impact printer in which print hammer apparatus embodying the present invention may be employed.

With reference now to FIG. 1, there is shown a portion of a drum printer in which print hammer apparatus embodying the present invention may be employed. The drum printer includes an upright or side frame or yoke member 10 to which is mounted a type die carrying drum 11 and an impeller wheel 12 which are both driven in synchronism by means of a motor 13 also mounted to the frame member 10. Projecting from the surface of the print drum are a plurality of type die which are arranged in a plurality of circumferential columns or belts. For the sake of convenience and ease of illustration only three type die 11*a* are illustrated in the form of the alphabetic characters A, B and C in one such column.

The motor 13 is coupled via a belt drive arrangement 15 so as to rotate the print drum 11 and the impeller wheel 12 in synchronism. To this end, pulleys 15*a* and 15*b* are mounted upon shafts 16 and 17, respectively, upon which the impeller wheel 12 and the print drum 11*e* are mounted, the shaft 16 and 17 as well as an idler shaft 18 are journaled in the upright frame member 10. Pulleys 15*c* are mounted on the idler shaft 18. Belt 15*d* couples the pulleys 15*a* to the shaft of the motor 13 which is not specifically illustrated in FIG. 1. The belt 15*e* in turn couples the pulleys 15*a* via the idler pulley 15*c* and another belt 15*f* to the pulley 15*b*. In one design embodying the present invention the belt and pulley drive arrangement 15 is dimensioned for an impeller wheel speed of 1,550 revolutions per minute and a print drum speed of 357 revolutions per minute for a motor speed of 1,750 revolutions per minute.

The upright or side yoke member 10 and the print drum 11 as well as well as a print medium 14 have been partially broken away to show a transverse frame member 19 which is at an angle to the vertical and which extends transversely between the upright or side yoke member 10 and a corresponding side yoke member (not shown) in which the other ends of the impeller shaft 16 and the print drum shaft 17 are journaled. Projecting from the surface of the frame member 19 are transversely extending locater bars 20 and 21 and locater pins 22 which project from another transversely extending bar 23. The locater bars and locater pins serve the purpose of aligning a number of hammer modules 30 (of which only one is shown for clarity of the drawing) with the character columns on the print drum 11 as well as an impact printing line which also extends transversely or longitudinally across the surface of the print drum 11. To this end, the hammer module 30 includes notches 31 and 32 which are adapted for registry with the transverse or horizontal locater bars 20 and 21 to facilitate alignment with the print line. The hammer module 30 also includes a cylindrically shaped recess or cavity 33 (shown only in FIG. 2) which is adapted for registry with a locater pin 22 so as to facilitate the alignment of the print hammer module with the character columns in the print drum. A plurality of apertures 24 extend through the bar 23 in substantial vertical alignment with the locater pins 22. These apertures are adapted to the fastening or securing of the hammer module 30 to the frame member 19 as, for example, by means of screws.

The print medium 11 generally includes a document upon which the printing operations are to be performed and in a preferred embodiment also includes a print ribbon which serves as a supply of ink to assure the printing of legible characters. In other designs, different ink supplies such as inking rollers and the like may be employed.

The hammer module 30 includes a number of print hammer mechanisms of which only one is illustrated in any detail in FIG. 1. The illustrated print hammer mechanism is shown to include an elongated hammer body 40 which is mounted to the body of the hammer module 30 by means of a flat flexure spring 35 so as to allow pivotal motion of the hammer body 40 toward and away from the print line. The mechanism further includes a flexible interposer 34 which is threaded through apertures 40*a* and 40*b* (shown only in FIG. 4) in the hammer body 40 and is adapted for movement from a normal position into the path of the rotating impeller 12 by means of a control element, such as a solenoid 36.

When the interposer 34 is moved into the path of the impeller wheel 12, it is engaged by one of a number of radially extending impeller teeth 12*a* and driven into engagement with the hammer body 40 with enough accelerating force to cause the interposer 34 and hammer body 40 to travel toward the print line in a pivotal motion due to the flexing or bending of the flat flexure spring 35 as well as the flexing of the interposer itself. The flexibility of the interposer in the plane of motion of the impeller teeth and in the plane of motion of the print hammer is an important aspect of the present invention. The flexible interposer imparts accelerating forces more slowly and smoothly to the print hammer than prior art interposers which are rigid in the plane of hammer and impeller tooth motion. This enhances the wearability and hence longevity of the impeller teeth, the interposer and the print hammer.

A further significant aspect of the present invention is the threading linkage of the interposer 34 to the hammer 40. This linkage allows the interposer to be moved from its normal position into the path of the rotating impeller teeth and also captivates the interposer to the hammer body so that it must travel with the larger mass hammer body toward the impact print line. This captivation serves to control oscillation of the flexible interposer. This control of the flexible interposer oscillation during the forward flight time toward the print line serves to prevent multiple strikes of the interposer by the impeller teeth. In a further aspect of the invention, the flexible interposer coacts with the flat flexure spring during rebound or the return flight time of the hammer to damp the hammer motion as it strikes the hammer backstop.

To elaborate on these features, reference is made to FIGS. 5A to 5D in which the hammer body 40 and impeller 12 are illustrated in outline form and the interposer 34 and flexure spring 35 in stick form. A hammer backstop is indicated generally at 37. The fastening of the flexure spring 35 to the hammer module body is indicated generally at 100. Finally, the fastening of the interposer 34 to the electromagnet 36 is indicated generally at 101.

Figure 5A:
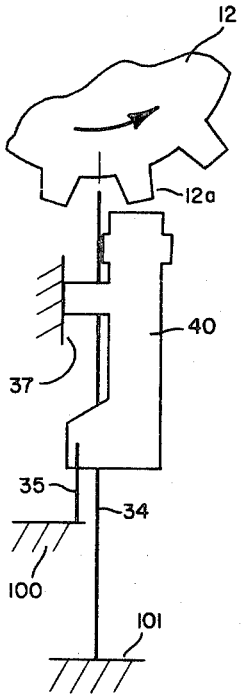
FIGS. 5A through 5D are skeletal views of a print hammer mechanism embodying this invention captured at various stages of its flight toward the print line and its return flight therefrom.
Figure 5B:
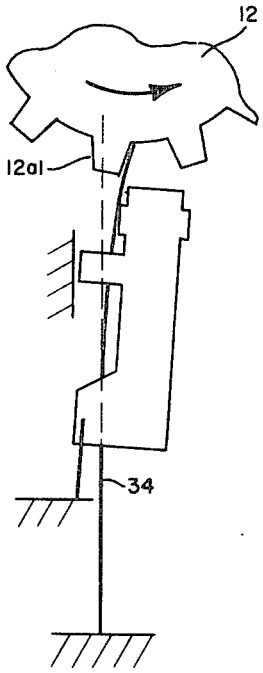

In FIG. 5A the interposer 34 is shown in the position where it has been moved into the path of the rotating impeller teeth 12*a* but has not yet been engaged by any of the teeth. Accordingly, neither the interposer 34 nor the flexure spring 35 are flexed at this point in time. In FIG. 5B the impeller 12 has rotated to the point where one of its impeller teeth 12*a*has engaged the interposer 34 and has flexed it into engagement with the hammer 40. As the wheel 12 continues to rotate, the interposer 34 continues to bend or flex and imparts an accelerating force to the hammer. The hammer then moves in a pivotal motion toward the print line as the flexure spring 35 begins to flex or bend.

Figure 5C:
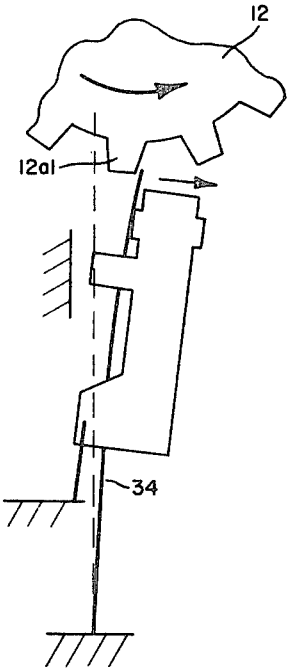
Figure 5D:
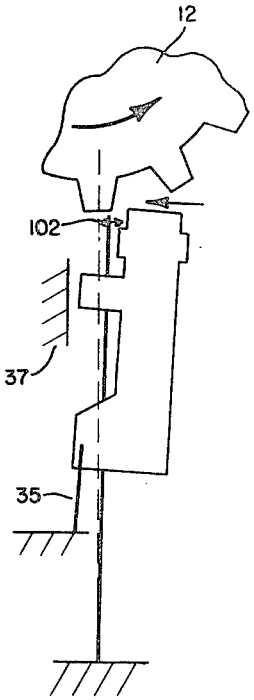

Due to the bending or flexing of the interposer 34, the application of the accelerating force to the hammer 40 is much smoother and slower than in prior art printing mechanisms which employ a rigid interposer. As the wheel 12 continues to rotate with the impeller tooth 12*a*1 in engagement with the interposer, the interposer continues to bend or flex. The point in time where the impeller tooth 12*a*1 has rotated far enough to become disengaged from the interposer 34 is shown in FIG. 5C. At this point in time as well as at the point in time where the interposer first makes engagement with the hammer body 40 there is a tendency for the interposer to rebound away from the hammer body in an oscillitory motion. This oscillitory tendency is controlled by the captivating linkage of the interposer to the hammer body 40 so that multiple strikes of the interposer 34 by the impeller tooth 12a1 or succeeding impeller teeth is prevented.

The electromagnet 36 (FIG. 1) is preferably de-energized as soon as sufficient energy has been applied thereto to project the interposer 34 into the path of the impeller teeth as in the situation shown in FIG. 5A. However, the recovery or return time of the electromagnet is rather slow and in many cases will not occur prior to the hammer body 40 reaching the print line. The bending of the interposer introduces a bending force to the interposer having a vertical component which enhances the return or downward movement of the interposer during the forward and return flights of the hammer.

After the impeller tooth 12a1 becomes disengaged from the interposer 34, the hammer 40 continues to move toward the print line where it impacts the print medium 14 with the type die on the print drum 11. This imparting causes the hammer body 40 to rebound away from the print line in a return flight toward the hammer backstop 37. During this return flight the interposer 34 tends to oscillate rather violently as indicated by the double ended arrow 102 in FIG. 5D. This oscillation is of course contained by the captivating linkage of the interposer to the hammer body 40. However, this oscillation is advantageously used to damp the oscillation of the flexure spring which occurs when the hammer body strikes the hammer backstop 37. This damping action is achieved by designing the dimensions of the interposer and of the flexure spring so that the interposer has a much lower spring rate and therefore lower frequency of oscillation than that of the flexure spring.

Figure 2:
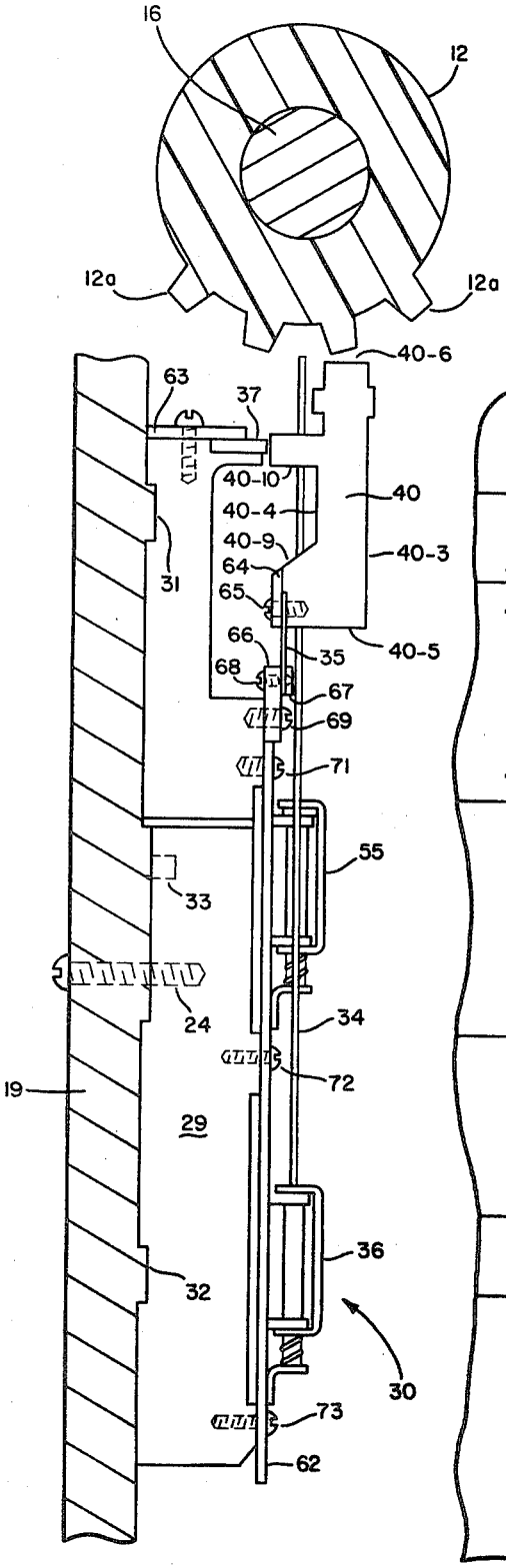
FIG. 2 is a cross-sectional view taken along the lines 2—2 of FIG. 1 which also shows a side view of print impacting apparatus embodying this invention, the view being rotated so as to be in alignment with the vertical.
Figure 3:
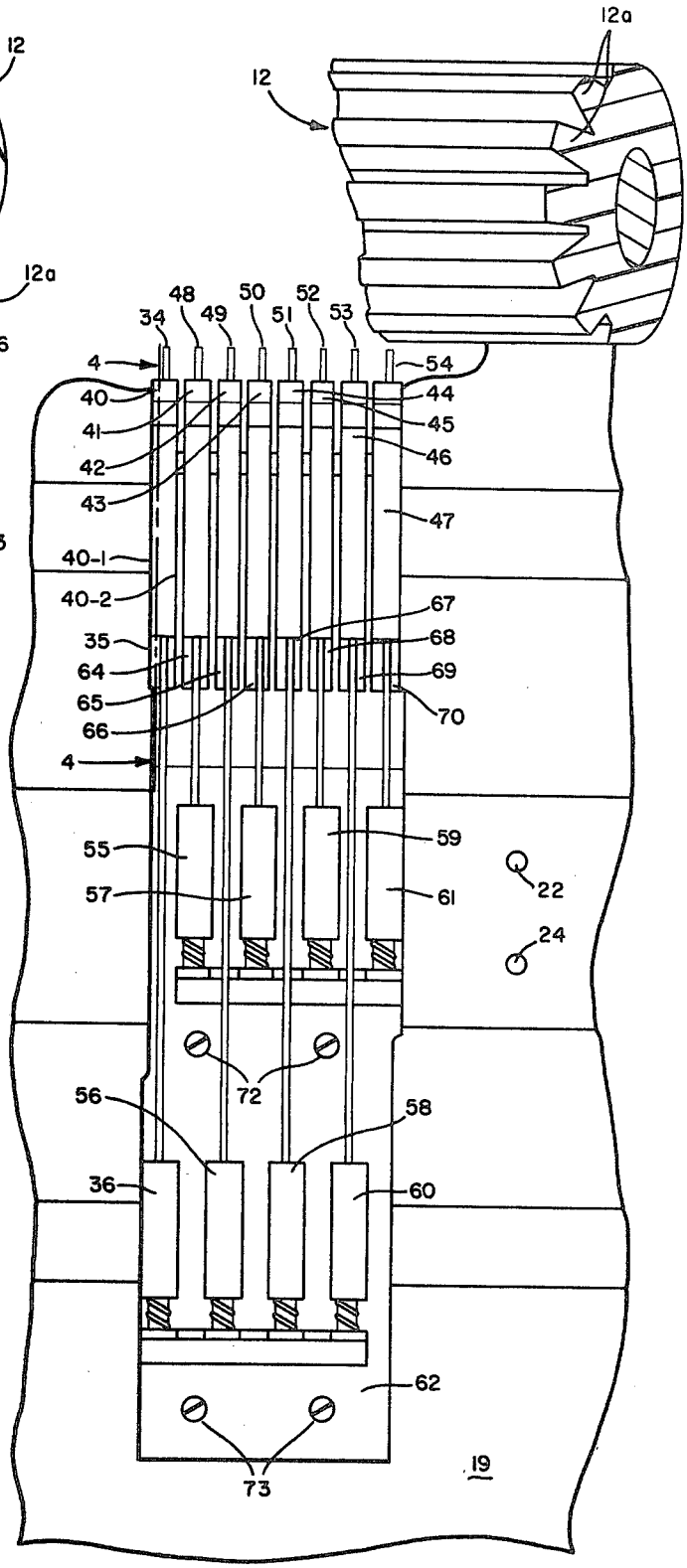
FIG. 3 is a front view of the print impacting apparatus.
Figure 4:
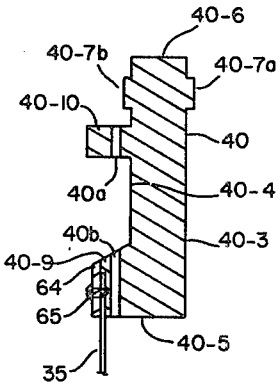
FIG. 4 is a cross-sectional view taken along the lines of 4—4 of FIG. 3 showing a hammer body of a print hammer mechanism embodying this invention.
Figure 7:
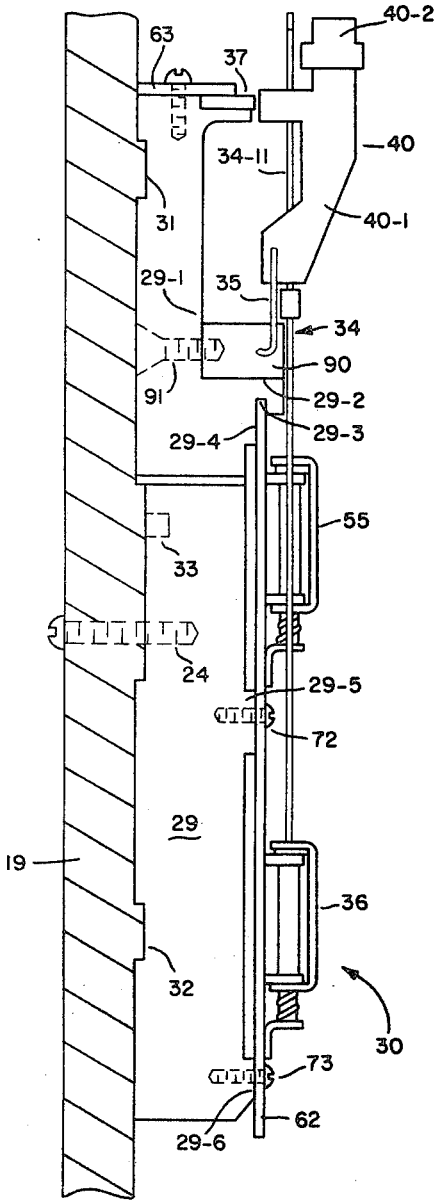
FIG. 7 is a cross-sectional view taken along the lines 2—2 of FIG. 1 which also shows a side view of another embodiment of print impacting apparatus of this invention, the view being rotated so as to be in line with the vertical.
Figure 8:
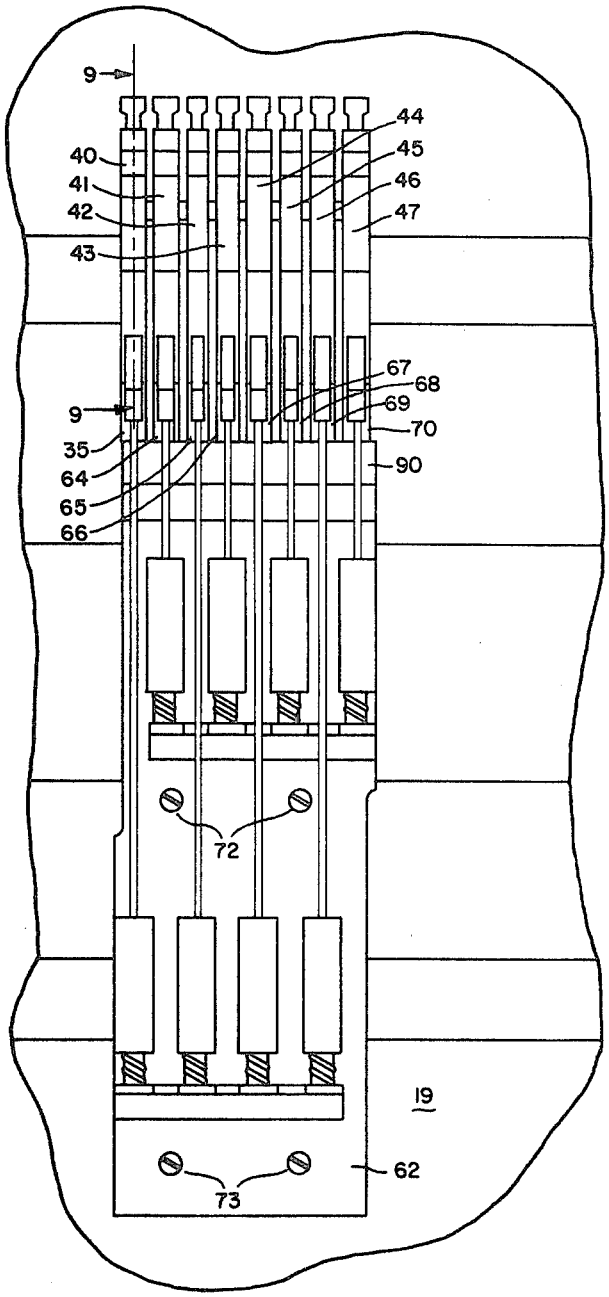
FIG. 8 is a front view of the FIG. 7 print impacting apparatus embodiment.

With reference now to FIGS. 2, 3 and 4 one specific design of a print hammer mechanism embodying the present invention will be described. The hammer module 30 is shown as comprising a module body or frame mounting which includes the notches 31 and 32 and the cylindrical recess 33 to facilitate mounting on the locater bar 20 and 21 and the locater pins 22 of the frame member 19. The module body has mounted to it a group of eight hammers 40 through 47, their associated interposers 34 and 48 through 54, respectively, and their associated electromagnets 36 and 55 through 61, respectively. Electromagnets 36 and 55 through 61, which are of the solenoid variety in this embodiment, have their armatures directly coupled to the associated interposers 34 and 48 through 54, respectively. In order to achieve close packing density of the hammers, four of the solenoids are mounted in a first or upper row and the other four solenoids are mounted in a second or lower row on a printed circuit board 62 which is in turn mounted upon the hammer module body 29. The spacing between the solenoids 55, 57, 59 and 61 in the upper row is such that the interposer elements 48, 50 and 52 may be threaded in between these solenoids.

Hammer 40 which is typical of each of the hammers is shown to include a pair of spaced apart and parallel planar surfaces 40-1 and 40-2 (see FIG. 3) which are joined by a front edge 40-3, a back edge 40-4, a base edge 40-5 and a hammer head edge 40-6. Near the hammer head edge are formed a hammer face 40-7a toward the front edge and an interposer striking face 40-7b toward the back edge. Also projecting from the back edge are portions 40-9 and 40-10.

Each of the interposers 34 and 48 through 54 are threaded through apertures which extend through their corresponding hammers 40 through 47. The hammer 40 is shown (FIG. 4) to include a pair of aligned apertures 40a and 40b. Aperture 40b extends through the rearward projecting portion 40-9 of the base of the hammer and the aperature 40a extends through the rearward projection 40–10 which is adapted to coact with the backstop 37. These apertures are slightly larger than the interposer so as to allow its movement into and out of the path of the impeller teeth but yet to captivate the interposer to the hammer body.

The flexure spring 35 is attached to the hammer 40 by means of a screw fastener 65 and a clamping block 64 as shown in both FIGS. 2 and 4. The flexure springs 64 through 70 are attached to their respective hammers 41 through 47 by a similar screw and clamping block, none of which are shown for the sake of simplicity. All of the flexure springs 35 and 64 through 70 are secured to the hammer module body by means of screw fasteners 68 and 69, spacer block 66 and clamping block 67. This detail of the flexure spring attachment to the hammer and hammer module body has been omitted from the FIG. 3 front view for the sake of clarity.

The printed circuit board 62 is secured to the hammer module 29 by means of screw fasteners 71, 72 and 73. The printed circuit board 62 typically includes printed circuit lands (not shown) from the lower edge of the board to individual ones of the solenoids. Electrical leads from the lower edge of the board (not shown) are provided for connection to print control logic (not shown).

Figure 6:
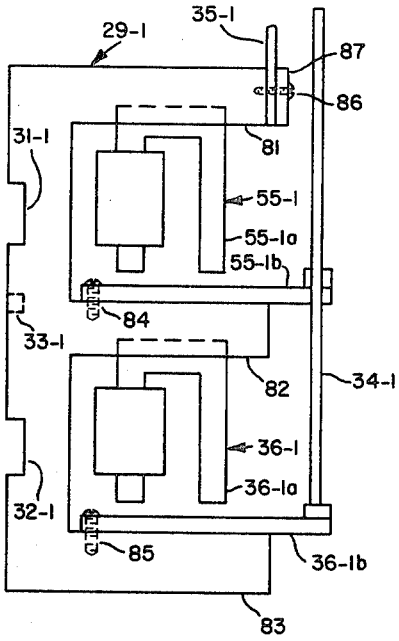
FIG. 6 is a side view of a portion of an alternative hammer module body illustrating the use of a hinged armature electromagnet which may also be employed in print hammer mechanisms embodying the present invention.

FIG. 5 illustrates another embodiment of the invention which employs hinged armature electromagnets in place of the solenoids shown in FIGS. 1 to 4. In FIG. 6 elements which substantially correspond to elements in FIGS. 1 to 4 embodiment are given the same reference numeral but hyphenated to the reference character 1. For example, the hammer module body is designated 29-1 in FIG. 6.

The hammer module body 29-1 includes grooves 31-1 and 32-1 and cylindrical cavity 33-1 to facilitate mounting on the frame member 19 of FIG. 1. Body 29-1 is E-shaped so as to have three legs 81, 82 and 83. Four of the electromagnets, including electromagnet 55-1 are mounted between legs 81 and 82 and four other electromagnets, including electromagnet 36-1 are mounted between legs 82 and 83. The bottom four electromagnets (including electromagnet 36-1) are offset from the upper four electromagnets similar to the offsetting of the corresponding solenoids in the FIGS. 1 to 4 embodiment. The electromagnet stator elements 55-1a and 36-1a are mounted in the lower surfaces of the legs 81 and 82 by any suitable fastening means (not shown). The electromagnet armatures 55-1b and 36-1b are secured to the legs 82 and 83 by screw fasteners 84 and 85 so as to allow pivotal motion of such armature toward and away from their associated stators.

The corresponding interposer elements including interposer 34-1 are secured to the unfastened ends of the armatures including armature 36-1b. Finally, the flat flexure springs including spring 35-1 are secured to the leg 81 by means of a screw fastener 86 and clamping block 87. The print hammer elements are not specifically illustrated in FIG. 6 since they are substantially identical in structure, function and coupling to the flat flexure spring and interposer elements.

Although the impeller wheel may be fabricated from any suitable material having an adequate hardness such as metal, plastic and the like, it has been found that the flexibility of the interposer allows the use of thermoplastic materials. This is advantageous because thermoplastic materials can be injection molded into the impeller wheel shape and are therefore less costly than many metallic equivalents. One suitable thermoplastic material which has been employed in a practical design is DELRIN AF thermoplastic material, a product of E. I. DuPont de Nemours and Company, Wilmington, DE. The flexible interposer and flexure spring may be chosen from any of the metallic materials having spring-like or resilient characteristics. Preferably, for the purpose of enhanced fatigue characteristics the flexure spring takes the form of a nickel-cobalt alloy.

Figure 11:
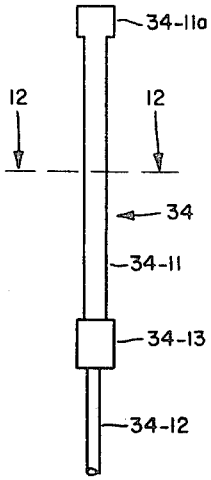
FIG. 11 is an elevation view of a flat flexible interposer which may be employed in the FIGS. 7 to 10 embodiment.
Figure 12:
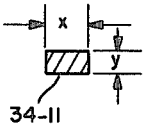
FIG. 12 is a cross-sectional view taken along the line 12—12 of FIG. 11.

Although the interposers for the embodiments above described are shown in the form of rods having a circular cross-section, it is contemplated that interposers having a different cross-section may be employed so long as the characteristic of flexibility or resiliency in the plane of motion of the hammer and impeller teeth is retained. FIGS. 11 and 12 illustrate one such alternate form of interposer which has been employed in one design embodying the invention. As shown in FIGS. 11 and 12, the interposer 34 takes the form of a flat flexure element 34–11 which is pointed to the electromagnet armature extension 34–12 by means of a sleeve element 34–13 and a fastening material, such as epoxy (not shown). As shown in FIG. 12 the flat flexure interposer element 34–11 has a substantially rectangular cross-section of dimension x and y where x>y. In addition, the upper tip of 34–11*a* of the flat interposer is slightly enlarged in the x dimension in order to provide more surface for engagement with the impeller teeth. This enhances the wearability of both the impeller teeth and the interposer 34.

Figure 9:
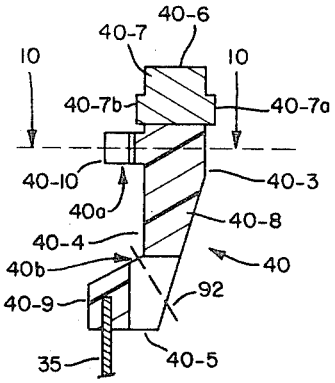
FIG. 9 is a cross-sectional view taken along the line 9—9 of FIG. 8 showing a hammer body of a print hammer mechanism of the FIGS. 7 and 8 embodiment.
Figure 10:
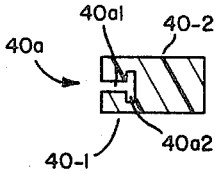
FIG. 10 is a cross-sectional view taken along the lines 10—10 of FIG. 9.

With reference to FIGS. 7–10 there is illustrated another preferred embodiment of the invention which employs a flat interposer and also a print hammer formed partly of thermoplastic material which allows low cost manufacturing processes to be employed. Hammer 40 is shown in FIGS. 9 and 10 to have a pair of spaced apart and parallel surfaces 40–1 and 40–2 which are joined by a front edge 40–3, a back edge 40–4, a base edge 40–5 and a hammer head edge 40–6. The hammer 40 is comprised of a metallic section 40–7 in which is formed the hammer face 40–7*a* and an interposer striking face 40–7*b* and a thermoplastic portion 40–8. Portions 40–9 and 40–10 are shown to project from the back edge 40–4 in the thermoplastic portion 40–8.

The thermoplastic portion 40–8 allows the use of injection molding processes to fabricate the portion 40–8 bonding it to the metallic hammer head portion 40–6 and also by means of the same processes imbedding the upper end of the flexure spring 35 in the projecting portion 40–9. The use of injection molding processes greatly simplifies the manufacturing process of the print hammer body 40. In addition, it leads to fabrication of the interposer captivating linkage by means of the same injection molding operation which forms the portion 40–8 and bonds it to the hammer head 10–6 and the flexure spring 35. Thus, the apertures 40*a* and 40*b* are formed in the rearward projections 40–10 and 40–9 at the time the body 40 is formed by means of injection molding.

An important feature of this embodiment is the shape of apertures 40*a* and 40*b* in that they permit the flat flexure interposer to be inserted with its x dimension parallel to the surfaces 40–1 and 40–2 and then rotated until its y dimension is parallel to such surfaces. This is accomplished by making the aperture 40*b* larger than the interposer x dimension in all directions and by forming the aperture 40*a* with a T-shape having an upright leg 40*a*1 and a crossleg 40*a*2, each having a length greater than x and a width greater than y. This allows the interposer to be inserted through both apertures 40*a* and 40*b* with its x dimension initially in the upright leg 40*a*1. The interposer is then rotated by 90 degrees until it snaps into place wholly within the crossleg 40*a*2. This greatly facilitates the threading or insertion of the interposer into the captivating linkage during the manufacturing or assembly process. In addition, aperture 40*b* is made larger at the base edge 40–5 (then at the top edge of projection 40–9). This allows the interposer to be inserted at an angle as illustrated by the dashed line 92 and then rotated in a pivotal motion for insertion into the leg 40*a*1 of the T-shaped opening in the 40*a*.

In a preferred form of the invention, the flexure springs 35 and 64 to 70 are secured to a hammer mounting block 90 which in turn is secured to the frame mounting block 29. This form of construction is highly advantageous as it results in a three piece construction which greatly enhances the final step of assembly at the time of manufacture as well as repair and maintenance of the hammer module. One of the three pieces is formed of the hammers 40 to 47, the associated flexure springs 35 and 64 to 70 and the hammer mounting block 90. Preferably the mounting block 90 also takes the form of thermoplastic material so that the mounting of the flexure spring therein can be performed by injection molding processes.

Figure 14:
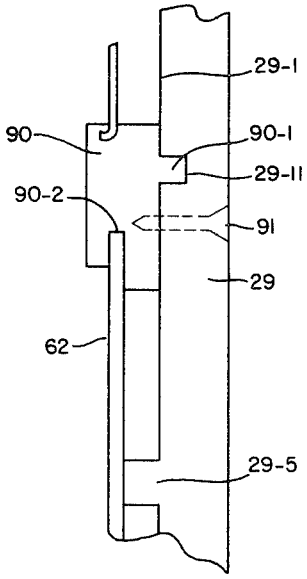
FIG. 14 is an elevation view of a portion of a print hammer assembly showing an alternative embodiment of the invention.

The other two pieces consist of the frame mounting block 29 and the printed circuit board 62 upon which is assembled the various solenoids and interposers. The frame mounting block 29 includes an upper portion having surfaces 29–1 and 29–2 shaped to mate with the hammer mounting block 90 and a lower portion consisting of a groove 29–3 and transverse projecting bars 29–4, 29–5 and 29–6 all of which are shaped to mate with the printed circuit board 62. The mounting block 90 is secured to the frame mounting block 29 by means of a screw fastener 91. One edge of the printed circuit board 62 fits snugly within the groove 29–3. The printed circuit board is then secured to the frame mounting block 29 by means of screw fasteners 72 and 73 at the transverse bars 29–5 and 29–6. The recessed spaces between the bars 29–4, 29–5 and 29–6 serve to accommodate any solder connections and a fastener element (not shown) for securing the solenoids such as solenoids 36 and 55, to the printed circuit board. An alternate embodiment of the three piece assembly is shown in FIG. 14. In this construction the groove which mates with the edge of the printed circuit board 62 is formed as a groove 90–2 in the hammer mounting block 90. The surface 29–1 of the frame mounting block 29 has a groove 29–11 which mates with a projecting bar or tongue 90–1 of the hammer mounting block 90. The hammer mounting block 90 is again secured to the frame mounting block 29 by means of a screw fastener 91. Frame mounting block 29 still include transverse bars such as bar 29–5 which are shaped to mate with the printed circuit board 62 and serve to facilitate the fastening of the printed circuit board thereto.

Figure 13:
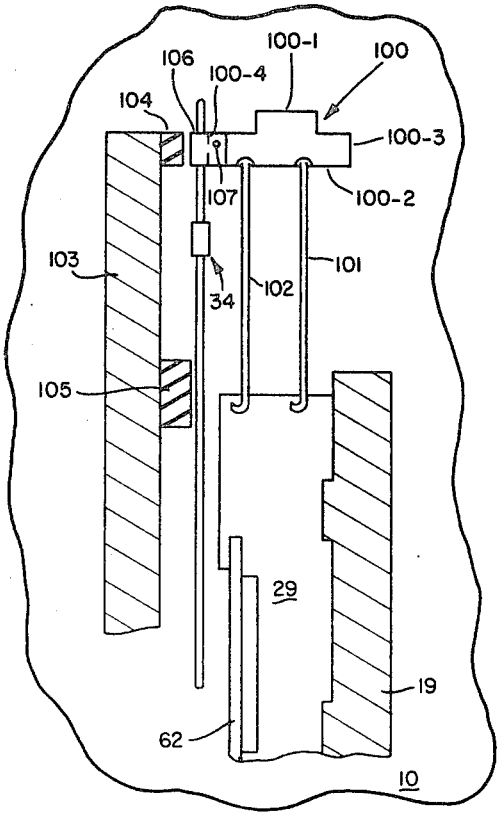
FIG. 13 is partly a cross-sectional view and partly an elevation view showing a further embodiment of the invention.

With reference now to FIG. 13 there is shown still another embodiment of the invention which employs a double flexure spring hammer 100. In this partly cross-sectional and partly elevational view, the hammer 100 has a pair of spaced apart and parallel surfaces which are defined and joined by the top edge 100–1 a base edge 100-2, a hammer base edge 100-3 and an interposer face striking edge 100-4. In this embodiment, the hammer 100 is secured directly to the frame mounting block 29 by means of a pair of flexure springs 101 and 102. It should be noted, however, that the flexure springs 101 and 102 could be mounted in a separate hammer block (not shown) which in turn could then be mounted to the frame mounting block 29 in a manner similar to the embodiment shown in FIGS. 7 and 8 and FIG. 14. The hammer 100 is preferably a metallic material in which the flexure springs 101 and 102 are imbedded by means of familiar epoxy imbedding techniques. Flexure springs 101 and 102 may simply be imbedded or anchored in the frame mounting block 29 at the time that it is formed in an injection molding process.

The frame mounting block 29 is adapted for mounting upon a transverse frame member 19 which extends from the upright or side frame member 10. An additional transverse frame member 103 extends from the side frame member 10 for the purpose of supporting damping elements 104 and 105. Damping element 104 serves as a backstop for the return flight of the hammer 100 while the damping element 105 serves to constrain or control the oscillation of the interposer 34. Damping elements 104 and 105 may be formed of any suitable material having resilient properties, such as rubber or other elastomeric materials.

The linkage which captivates the interposer 34 to the hammer 100 consists of a snap clip element 106 having a dimple 107 which coacts with a corresponding indentation in the surface of the hammer 100 to hold the snap clip in place.

While preferred embodiments of the invention have been shown in the drawings, it is to be understood that this disclosure is for the purpose of illustration only and that various changes in shape, proportion and arrangement of parts, as well as the substitution of equivalent elements for that herein shown and described, may be made without departing from the spirit and scope of the invention set forth in the appended claims.

What is claimed is:

1. In an impact printer having a printer frame to which is mounted carrier means for periodically presenting a plurality of type die to a print line adjacent a document on which a printing operation is to be performed, and a print impacting mechanism, including at least one print hammer arranged to impact the document with selected ones of the type die at the print line, a source of mechanical energy including an impeller having at least one impeller tooth rotating in synchronism with the periodic presentation of the type die by the carrier means, an interposer having a mass smaller than the mass of the hammer and associated with the hammer and arranged for selective movement by a control element from a normal position into the path of motion of the impeller tooth such that the impeller tooth engages the interposer driving it and the associated print hammer from a rest position toward the print line to impact the document with a selected type die, said impeller tooth and hammer having the same plane of motion; said print impacting mechanism being characterized by the print hammer having a pair of spaced apart and generally parallel surfaces defined by a base end, a hammer head end and by a front and a back edge, the hammer head end having a hammer face toward the front edge and an interposer striking face toward the back edge, first and second spaced apart portions projecting from the back edge near the hammer head and base ends, respectively, with the base end being secured to the printer frame to allow pivotal motion of the hammer; by said interposer having a length 1 and a generally rectangular cross-section of dimensions x and y, where x is greater than y, and which is arranged to have its surface defined by the x dimension engaged by said impeller tooth; by said interposer being mechanically coupled to said print hammer in a linkage which allows motion of the interposer into and out of the path of said impeller tooth and captivates the smaller mass interposer to travel with the larger mass hammer after engagement of the interposer by the impeller tooth; by said interposer being flexible in the plane of motion of said hammer and impeller tooth and flexing in such plane when engaged by the impeller tooth such that a relatively smooth accelerating force is imparted to the print hammer and such that the removal of the interposer from the path of the impeller tooth and return to the normal position after such engagement is enhanced by such flexing and by the captivation linkage to the print hammer; said linkage being characterized by an aperture through said second portion in a direction generally parallel to said surfaces and large enough to allow insertion of the interposer with its x dimension parallel to said surfaces and to also allow rotation thereof until its y dimension is parallel to said surfaces and further characterized by a T-shaped opening through the first portion in a direction generally parallel to said surfaces and both legs of the T having a width slightly larger than y with the cross leg of the T having a length slightly larger than x so that the interposer may be inserted through both the aperture and the opening with its x dimension parallel to said surfaces and then rotated until it fits entirely within the cross leg of the T-shaped opening with its y dimension parallel to said surface.

2. A print hammer adapted for coupling to an interposer having length 1 and a generally rectangular cross-section of dimensions x and y, where $x>y$, said print hammer including a body having a pair of spaced apart and generally parallel surfaces defined by a base end and a hammer heed end and by a front and a back edge, the hammer head end having a hammer face toward the front edge and an interposer striking face toward the back edge, first and second spaced apart portions projecting from the back edge near the hammer head and base ends, respectively, and adapted for coupling to the interposer in a captivating linkage which allows motion of the interposer in a direction substantially parallel to said surfaces and also which captivates the interposer to the print hammer; said print hammer being characterized by an aperture through said second portion in a direction generally parallel to said surfaces and large enough to allow insertion of the interposer with its x dimension parallel to said surfaces and to also allow rotation thereof until its y dimension is parallel to said surfaces, and further characterized by a T-shaped opening through the first portion in a direction generally parallel to said surfaces with both legs of the T having a width slightly larger than y with the cross leg of the T having a length slightly larger than x so that the interposer may be inserted through both the aperture and the opening with its x dimension parallel to said surfaces and then rotated until it fits entirely within the cross leg of the T-shaped opening with its y dimension parallel to said surfaces.

3. A print hammer as set forth in claim 2 which is further characterized by a metallic portion and a thermoplastic portion with the metallic portion forming said hammer face and interposer striking face.

4. A print hammer as set forth in claim 3 which is further characterized by a plastic mounting body which is secured to the impact printer frame and is further characterized by said flat flexure spring being imbedded in both said plastic mounting block and in said plastic portion of the print hammer body.

* * * * *